US005513448A

United States Patent [19]

Lyons

[11] Patent Number: 5,513,448

[45] Date of Patent: May 7, 1996

[54] ATHLETIC SHOE WITH COMPRESSION INDICATORS AND REPLACEABLE SPRING CASSETTE

[76] Inventor: Levert Lyons, 14667 Cedar Grove, Detroit, Mich. 48105

[21] Appl. No.: 269,842

[22] Filed: Jul. 1, 1994

[51] Int. Cl.[6] ..... A43B 13/28; A43B 13/18; A43B 21/30

[52] U.S. Cl. ..... 36/28; 36/27; 36/29; 36/38

[58] Field of Search ..... 36/27, 28, 29, 36/7.8, 38, 34 R, 37

[56] References Cited

U.S. PATENT DOCUMENTS

| | | | |
|---|---|---|---|
| 2,299,009 | 10/1942 | Denk | 36/38 X |
| 2,454,951 | 11/1948 | Smith | 36/38 |
| 2,669,038 | 2/1954 | De Werth | 36/38 |
| 3,878,626 | 4/1975 | Ismann | 36/15 |
| 4,187,620 | 2/1980 | Selner | 36/28 |
| 4,267,648 | 5/1981 | Weisz | 36/28 |
| 4,391,048 | 7/1983 | Lutz | 36/28 |
| 4,486,964 | 12/1984 | Rudy | 36/28 |
| 4,506,460 | 3/1985 | Rudy | 36/28 |
| 4,534,124 | 8/1985 | Schnell | 36/114 |
| 4,638,575 | 1/1987 | Ilustrato | 36/38 |
| 4,715,130 | 12/1987 | Scatena | 36/28 X |
| 4,774,774 | 10/1988 | Allen, Jr. | 36/28 |
| 4,815,221 | 3/1989 | Diaz | 36/28 X |
| 4,843,741 | 7/1989 | Yung-Mao | 36/114 |
| 4,887,367 | 12/1989 | Mackness et al. | 36/28 |
| 4,910,884 | 3/1990 | Lindh et al. | 36/28 |
| 5,042,175 | 8/1991 | Ronen et al. | 36/28 |
| 5,060,401 | 10/1991 | Whatley | 36/25 R |
| 5,155,927 | 10/1992 | Bates et al. | 36/28 |
| 5,212,878 | 5/1993 | Burke et al. | 36/27 |
| 5,224,278 | 7/1993 | Jeon | 36/27 X |
| 5,255,451 | 10/1993 | Tong et al. | 36/30 R X |
| 5,279,051 | 1/1994 | Whatley | 36/25 R |
| 5,282,325 | 2/1994 | Beyl | 36/27 |

FOREIGN PATENT DOCUMENTS

| | | | |
|---|---|---|---|
| 0472110 | 2/1992 | European Pat. Off. | 36/29 |
| 9110376 | 7/1991 | WIPO | 36/28 |

*Primary Examiner*—Paul T. Sewell
*Assistant Examiner*—BethAnne C. Dayoan
*Attorney, Agent, or Firm*—Reising, Ethington, Barnard & Perry

[57] ABSTRACT

An athletic shoe (10) has a bottom sole (12) and a removable insole (16). The bottom sole (12) has two cavities (24) and (26) that are accessible from the interior (22) of the shoe. Respectively sized removably mounted cushioning cassettes (30) and (32) are removably mounted in the cavities (24) and (26). Each cassette is resiliently flexible and has spring elements (44) seated therein. Viscous fluid indicators (60) and (80) are also mounted on the shoe to determine the impact stresses and compression fit of the shoe on the foot.

10 Claims, 2 Drawing Sheets

ATHLETIC SHOE WITH COMPRESSION INDICATORS AND REPLACEABLE SPRING CASSETTE

TECHNICAL FIELD

The field of this invention relates to footwear and more particularly to athletic shoes that incorporate improved cushioning devices and compression indicators.

BACKGROUND OF THE DISCLOSURE

Footwear has been developed and become popular that has an outer sole bonded to a mid-sole that is bonded to a shoe upper. An insole is removably mounted in the shoe above the mid-sole. The mid-sole usually has at least one layer of molded cushioning foam elastomeric material that is bonded to the outer sole that has a bottom durable tread surface. The cushioning foam material initially provides adequate cushioning against impact forces during running and jumping. The outer sole material with its tread surface has been improved to such an extent that it often outlasts the cushioning properties of the cushioning foam material of the mid-sole. The inner sole may be replaced as needed.

During specific sports, the impact of compression on the outer sole is highly uneven with most of the compression impact forces occurring in a few concentrated areas of the shoe. As such, the cushioning properties of the foam material in the mid-sole can wear out certain areas of the shoe while the remainder of the shoe, particularly the tread surface and the shoe upper that is commonly made from leather or canvas material maintains a useful and cosmetically acceptable condition.

For example, in basketball, there is tremendous compressive and impact forces exerted on the ball section and the heel portion of the shoe. As such, the wear pattern on the outer sole is heavily concentrated on the ball section and heel section of the outer sole. If there is insufficient cushioning, risk of injury increases to the foot and or ankle. If the cushioning is too soft, it may be overly compressed, i.e. it may bottom out and create jarring on the foot and ankle thereby also increasing fatigue and risk of injury. If the cushioning is too stiff, it also provides unnecessary jarring to the foot and ankle. The level of cushioning ideally is different for different people. The main factors to determine the appropriate cushioning are the weight of the person and the intensity of the activity i.e. how high the person jumps or how fast he runs.

From the above description it becomes clear that it is advantageous for having a replaceable spring cushioning cassette that can be customized to provide optimum cushioning for the wearer and can be easily installed into the mid-sole of the shoe particularly at the areas of highest impact and wear. Secondly, it is also desirable to determine the compressive impact stresses exerted on the shoe to help determine the optimum cushioning cassette and maintain a consistent fit and cushioning resistance needed for the particular shoe and wearer.

SUMMARY OF THE DISCLOSURE

In accordance with one aspect of the invention, an athletic shoe has a bottom sole. The bottom sole is commonly molded with an outer sole having a bottom tread and a cushioned mid-sole. The bottom sole and an upper leather or nylon section are sewn or otherwise bonded together to form an interior sized for receiving a human foot. An insole is removably mountable in the interior of the shoe and normally mounted over an upper surface of the bottom sole. The mid-sole has a cavity that is accessible through its upper surface such that it is accessible from the interior of the shoe.

A flexible resilient cassette is removably mounted in the cavity. The cassette has an outer wall contoured to form a portion of a fastener assembly. The side walls about the cavity contoured to provide a second portion of the fastener assembly to fasten the cassette securely in the cavity. The first and second portions of said fastener assembly preferably form a snap fit fastener assembly such that when the bottom sole is in a relaxed and approximately straight position, the cassette may be snap fitted into the cavity of the bottom sole. The cassette is normally secured in place within the cavity during normal use of the shoe.

The cassette is removable from the cavity. Removing of the inner sole and flexing of the bottom outer sole pops the cassette out of the cavity. The flexing is such that the sole's heel and forward end move downwardly with respect to the center section of the sole. When the shoe is flexed as such, the first portion of the fastener assembly disengages from the second portion of the fastener assembly. The cassette can then be removed from the interior of the shoe.

The cassette preferably has a bottom section and a top section with at least one spring element interposed therebetween. The bottom section and top section are secured together to lock the spring element in position therebetween. Preferably, one of the top and bottom sections of the cassette has a plurality of enclosing vertical walls that defines in part a plurality of spring seats and to constrain the lateral motion of the springs. The other section of the cassette has a plurality of extending tapered walls with distal ends that telescopically fit within the spring seats of the one section. The tapered walls abut the walls after a predetermined amount of motion of the top section toward the bottom section to form a compressive stop to resist further compressive motion of the top section toward the bottom section. Preferably a plurality of coil springs are mounted in the spring seats of the upper and bottom sections of the cassette.

In accordance with another aspect of the invention, a cassette can be mounted in a cavity located in the heel portion of the bottom sole. A bladder is movably mounted over the cavity to overlie the cassette. The bladder is filled with a viscous colored fluid. A vertically disposed normally empty chamber is mounted in the rear heel portion of the upper section of the shoe. The chamber is in fluid connection with the bladder via a passage extending therebetween to receive the viscous colored fluid and having a transparent wall section such that the amount of fluid within the chamber is visible from the exterior of the shoe. Indicia marks are in proximity to the transparent wall section to serve as an indicator to determine the amount of the viscous fluid that entered the chamber upon impact on the heel section of the shoe. The amount of fluid entering the chamber indicates the level of impact encountered by the cassette in the heel portion of the outer sole.

In accordance with another aspect of the invention, a cassette insert for an athletic shoe includes a bottom section and a top section with a spring element interposed therebetween. The bottom section and top section are secured together via a peripheral wall that surrounds the spring element to lock the spring element in position therebetween. The peripheral wall has an outer facing surface that has outwardly extending protrusions that form part of a snap fit assembly constructed for snap fitting into the cavity within the bottom sole of the shoe.

In accordance with another aspect of the invention, an athletic shoe has the bladder disposed in a portion of said shoe. The bladder is filled with a colored viscous fluid. The chamber is mounted in the shoe and is in fluid connection with said bladder via a passage to receive the colored viscous fluid. The chamber has its transparent wall section mounted such that the amount of fluid within said chamber is visible from the exterior of said shoe. The indicia marks in proximity to the transparent wall section serve to indicate the amount of viscous fluid entering the chamber upon exertion of forces on the shoe.

In one embodiment, the bladder and the chamber are located in a tongue section of the shoe upper and the bladder being compressed by tie devices to fasten the shoe onto said foot such that the fluid within the chamber indicates the tightness of the shoe being fitted upon the foot.

In another embodiment, the bladder is within a heel portion of said outer sole and receives impact exerted by a heel of a foot and the chamber receives the viscous fluid upon impact of said outer sole upon landing to determine the level of impact encountered by the heel portion of the outer sole.

BRIEF DESCRIPTION OF THE DRAWINGS

Reference now is made to the accompanying drawings in which.

DETAILED DESCRIPTION OF THE PREFERRED EMBODIMENT

Figure 1:
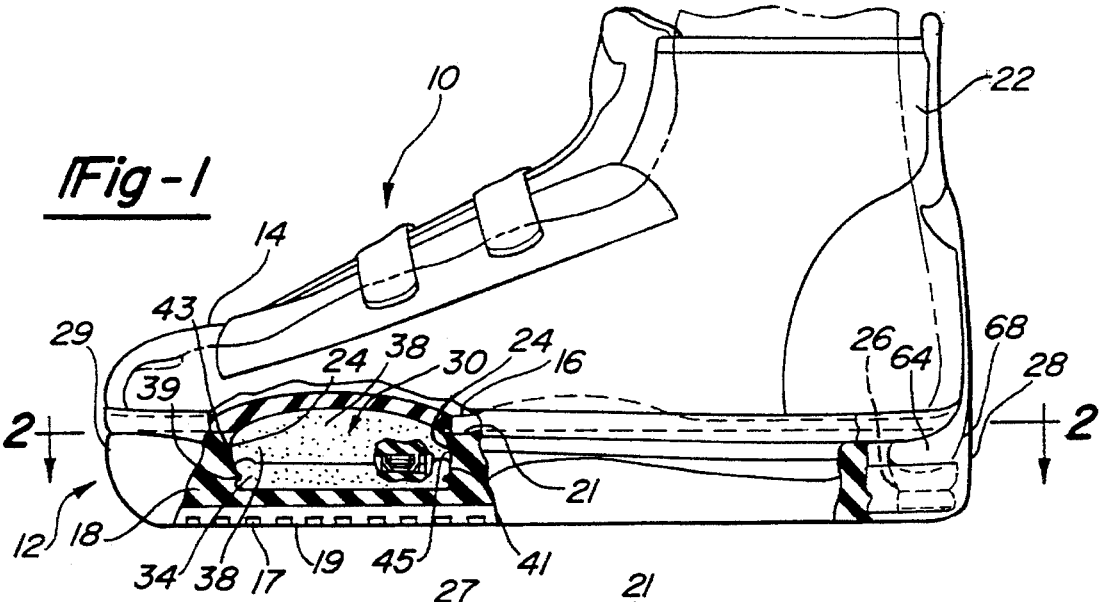
FIG. 1 is a side elevational and partially segmented view of shoe illustrating one embodiment of the invention.
Figure 2:
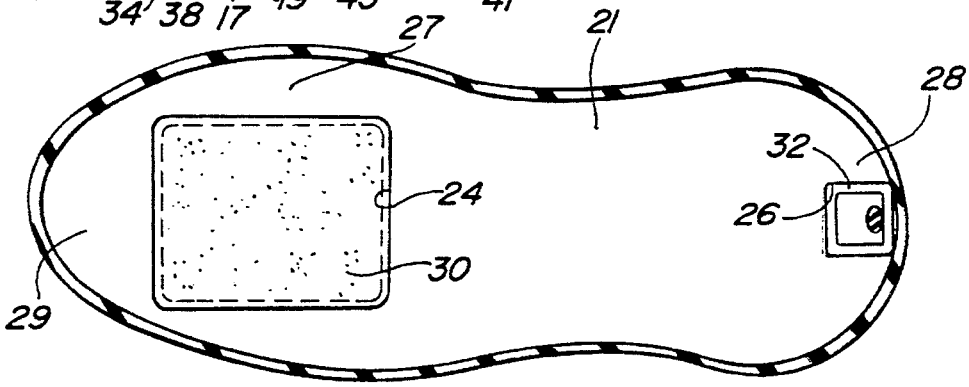
FIG. 2 is a plan view of the upper surface of the mid-sole shown in FIG. 1.

Referring now to FIGS. 1 and 2, an athletic shoe 10 includes a bottom sole 12, shoe upper 14 that is bonded to the bottom sole 12 and a removable insole 16. The bottom sole 12 can be a molded and laminated molded assembly made from a elastomeric cushioning foam mid-sole 18 and a lower wear resistant outer sole 19 with tread 17.

The foam mid-sole 18 has an upper surface 21 facing the interior 22 of the shoe 10. Extending through the upper surface and into the cushioning foam 18 are two cavities 24 and 26. Cavity 24 is located in generally the ball section 27 immediately behind the front toe section 29 of the outer sole and cavity 26 is located in the heel section 28 of the sole 12. Respectively sized removably mounted cushioning cassettes 30 and 32 are mounted in the cavities 24 and 26.

Figure 3:
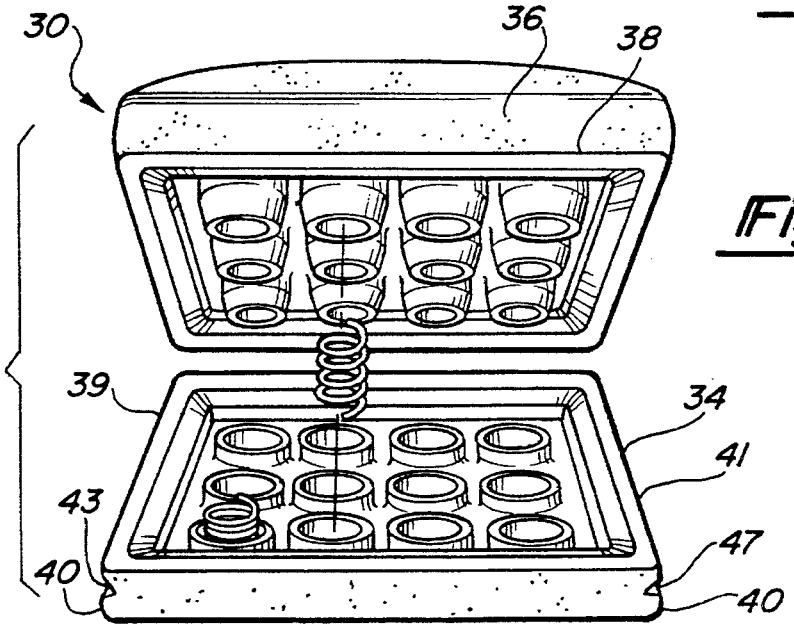
FIG. 3 is an exploded view of the cassette illustrated in FIG. 1.
Figure 4:
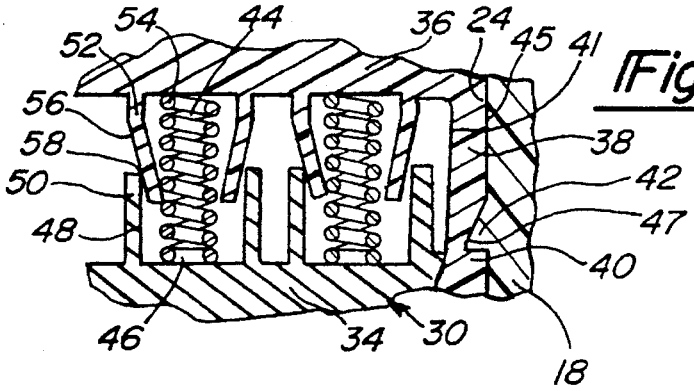
FIG. 4 is an enlarged fragmentary and cross-sectional view of the cassette taken along lines 4—4 shown in FIG. 1.

As shown in FIGS. 1, 3, and 4 cassette 30 has a lower section 34 and upper section 36 sonically welded together to form a peripheral wall section 38. The lower section and upper section are made from a elastomer that has supportive structure yet is resiliently flexible under a load. A number of commercially available plastics provide these properties. The peripheral wall 38 has a front surface 39 and a rear surface 41 incorporating snap fit protrusions 40 below groove 47 that snap fit and engage snap fit fasteners 42 molded about the cavity 24 along its front end 43 and rear end 45.

As shown in FIGS. 3 and 4, the interior of the cassette 24 houses a plurality of coil springs 44. Each coil spring 44 has its lower end 46 seated in a cylindrical shaped spring seat 48 in lower section 34. Each seat has an upright cylindrical vertically disposed wall 50. The upper section 36 similarly has a plurality of spring seats 52 which seats the upper end 54 of the coil spring 44. Each spring seat 52 has a tapered downwardly depending wall 56 that slidably and telescopically fits within cylindrical wall 50. The walls 56 slide in walls 50 as lower section 34 and upper section 36 are compressed toward each other against the resistance of the coil springs 44 until the taper walls abut against each other to provide a stop 58 that prevents over compression of the springs 44.

Figure 7:
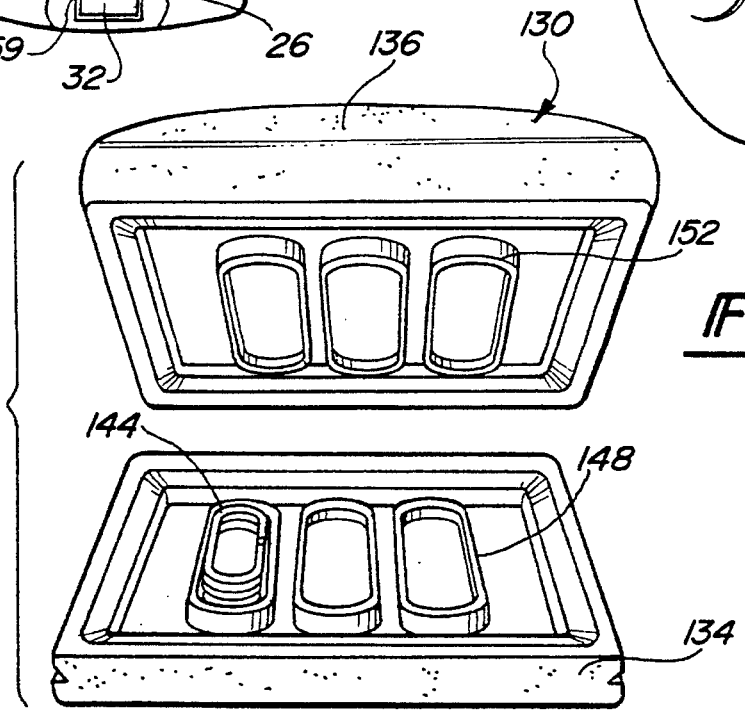
FIG. 7 is an exploded view illustrating a second embodiment of a cassette.

Other embodiments are contemplated. For example, the springs elements may be made from a resilient elastomeric material and shaped as cylinders. As shown in FIG. 7, the cassette 130 may have its halves 134 and 136 incorporate spring seats 148 and 152 respectively. The seats 148 and 152 may be elongated to house elongated non-cylindrical coil springs 144.

When the insole 16 is removed, the cassette 30 can be introduced into the interior of the shoe and snap fitted into the cavity 24 when the bottom sole 12 is in a relaxed and non flexed and approximately straight position as shown in FIG. 1. The inner sole is then repositioned properly within the shoe on top of the upper surface 21 of the mid-sole and covering the cassette 30 as shown in FIG. 1.

During normal use, the upward flexing of the front toe section 29 and heel section 28 exerts forces on the snap fit fasteners 40 and 42 that retain the cassette 30 securely within the cavity 24. The compression exerted by the ball of the person's foot onto the cassette 30 causes the cassette 30 to compress thereby compressing springs 44 and the plastic of the cassette halves 34 an 36. The walls 38 help resist lateral forces onto the cassette. Furthermore, the snug fit of walls 38 in cavity 24 also resist laterally directed forces.

When the cassette 30 needs to be repaired or replaced due to wearing out or it is desired to replace it with a cassette having different cushioning properties, the insole 16 is first removed. The shoe then has its front toe section 29 and heel section 28 flexed downwardly with respect to the center ball section 27 to disengage the snap fit fasteners 40 and 42 from each other and allow the cassette 30 to be removed from the cavity 24 and the interior of the shoe.

Cassette 32 is fitted into the cavity 26 in the same fashion as cassette 30. The cassette 32 is smaller and may have only one spring element 44 mounted therein within the peripheral side wall 59 of the cassette 32.

Cassettes 30 and 32 may be fitted with spring elements 44 having differing compressive forces to customize the shoe to the weight of the person and the active intensity level of the person. For heavier people, heavier, i.e. stronger, spring elements 44 may be desired. For more athletic individual whose activities are more intense, heavier spring elements may also be desired. For less intense workout levels and for lighter people, softer springs are desired to lessen the impact forces on the heel.

Figure 5:
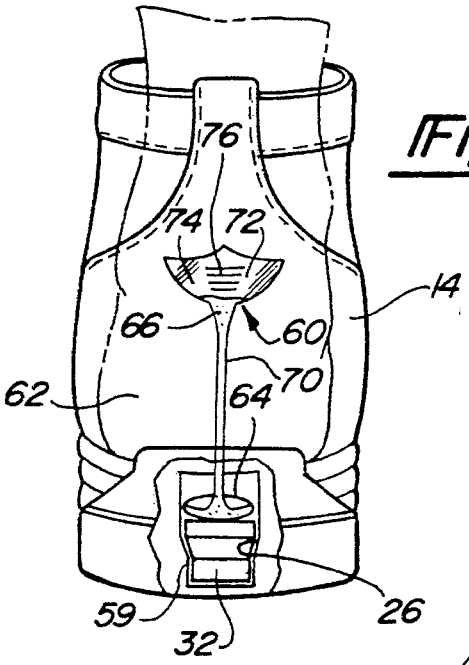
FIG. 5 is a rear elevational view of the shoe shown in FIG. 1.
Figure 6:
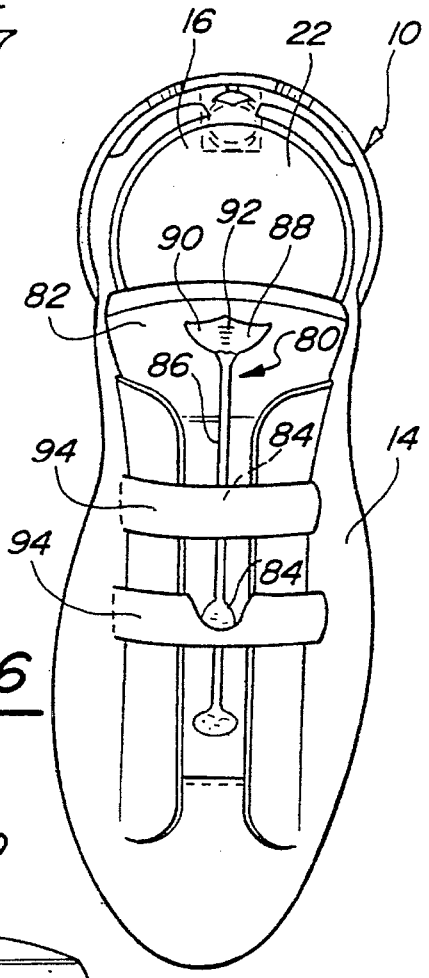
FIG. 6 is top plan view illustrating the tongue section of the shoe shown in FIG. 1.

In order to determine the best spring elements for the cassette 32, an impact device generally labeled as 60 in FIG. 5 is attached to the rear heel portion 62 of shoe upper 14. The indicator device has a lower bladder 64 that overlies the cassette 32 and lies under insole 16. The bladder is filled with a colored viscous fluid 66. The bladder 64 is only attached at its rear end 68 such that it can fold up to allow cassette 32 to be installed and removed from cavity 26. A tube 70 is operably connected to the bladder to form a passage for the fluid exiting the bladder. The upper end of tube 70 is operably connected to a chamber 72 that is affixed into the rear heel portion 62. The chamber 72 may be a plastic envelope or other construction to form a rear transparent window section 74 that is visible from the exterior of the shoe. The rear transparent window 74 may have indicia 76 such as lines and numbers. The chamber 72 is normally empty or has viscous fluid only up to a predetermined amount that may be marked as the zero level. The tube 70 is relatively narrow or has a built in restrictor that allows restricted motion of the viscous fluid between the bladder 64 and chamber 72.

Upon high impact on the heel section 28 that occurs during jumping or running, the bladder is squeezed by the compression forces exerted by the persons heel and the cassette 26. A certain amount of colored viscous fluid therein is squeezed out and through the passage into chamber 72, the amount depending on the force of the impact. Immediately after impact, the viscous fluid is drawn back into the bladder but the high viscosity of the colored fluid allows a colored film to temporarily remain on the window section 74 to indicate how much fluid entered into the chamber 72 during impact which can be measured by indicia 76. The restriction provided by the tube 70, the high viscosity of the liquid, and the compression of air within chamber 72 provides the controlled resistance to the motion of liquid into chamber 72.

If the spring cassette 30 is worn out or does not have enough resistant, the impact forces will be higher due to the cassette bottoming out as described above. The bladder then receives the full impact of the heel and the fluid reaches a relatively high level in the chamber 72. If the spring elements are overly stiff for the person, the chamber also indicates a high level of impact. When an optimum new cassette 26 is installed, the spring 44 absorbs a significant portion of the impact and the fluid level reached in the chamber 72 is lower during the impact activity. As such, the chamber helps a person custom fit the shoe to his weight and activity and to help minimize maximum impact forces exerted on his heel which can reduce injury and fatigue to the foot.

The shoe can be further customized by using a similar fluid indicator assembly 80 mounted on the tongue 82 of the shoe upper 14. Several fluid containing bladders 84 are affixed along the longitudinal axis of the tongue. The fluid in the bladders 84 is a viscous colored fluid. Each bladder 84 is operably connected to a restrictive passage 86 that leads to a normally empty chamber 88. The chamber is affixed to the upper distal end of the tongue 82 and has a visible window section 90 with appropriate indicia 92. The bladders 84 are positioned such that when the shoe laces are tied or the Velcro™ straps 94 as shown are fastened, the bladders 84 are compressed to squeeze the fluid into the chamber 88 and rises to one of the indicia. Each time a person wears the shoes in accordance with the invention, a person can tighten the shoe to a consistent fit by tightening the fasteners such that the fluid rises to the same level in chamber 88.

In this fashion, the shoe can be easily customized to the spring cushioning desired by the individual person and can be fitted in a consistent manner. Furthermore the durability of the shoe can be increased by having a easily replaceable cassette. The cushioning cassettes receive the most impact stresses and compression forces and naturally may wear out before the other less actively used areas of the shoe. The cassettes can be easily replaced as necessary while the remainder of shoe remains in relatively acceptable condition. Furthermore, in this fashion, it is easily determined what cassette with a certain spring strength is needed by visually looking at the impact indicator at the heel portion of the shoe after high impact activity.

Variations and modifications are possible without departing from the scope and spirit of the present invention as defined by the appended claims.

The embodiments in which an exclusive property or privilege is claimed are defined as follows:

1. An athletic shoe characterized by:

a bottom cushioned sole;

shoe upper connected to said bottom cushioned sole and forming with said sole an interior sized for receiving a human foot;

an insole removably mountable in the interior of said shoe and normally mounted over an upper surface of said bottom sole;

said bottom sole having a cavity that is accessible through its upper surface such that it is accessible from the interior of said shoe;

a flexible resilient cassette mounted in said cavity;

said cassette having an outer wall contoured to form a first portion of a fastener assembly;

said cavity having a side wall contoured to provide a second portion of said fastener assembly;

said cassette made from a resiliently flexible material;

said cassette normally being positively secured in place within said cavity during normal wear and flexing of said shoe sole during use on a foot via said fastener assembly with first and second portions forming a positive interlock;

said cassette being removable from said cavity by removal of said inner sole and flexing of said bottom sole such that its rear and forward ends move downwardly with respect to its center section to disengage said first portion from said second portion of said fastener assembly and allow removal of said cassette from said cavity and from said interior of said shoe.

2. A shoe as defined in claim 1 further characterized by;

said first and second portions of said fastener assembly form a snap fit fastener assembly such that when said sole is in a relaxed and approximately straight position, said cassette may be snap fitted into said cavity of said sole;

said first fastener portion being at a front and rear portion of said cassette and said second fastener portion being on a front wall and rear wall of said cavity.

3. A shoe as defined in claim 1 further characterized by;

said cassette having a bottom section and a top section with at least one spring element interposed therebetween;

said bottom section and top section secured together to lock said at least one spring element in position therebetween.

4. A shoe as defined in claim 3 further characterized by;

one of said top and bottom sections of said cassette having a plurality of enclosing vertical walls that defines in part a plurality of spring seats;

the other of said top and bottom sections of said cassette having a plurality of extending tapered walls with distal ends that telescopically fit within the spring seats of the bottom section and abut said walls at a predetermined amount of motion of the top section toward the bottom section to form a compressive stop to resist further motion of the top section toward said bottom section.

5. A shoe as defined in claim 4 further characterized by;

said at least one spring element being at least one coil spring with an upper end mounted in a respective spring seat of the upper section and a lower end mounted in a respective spring seat of the bottom section of said cassette.

6. A shoe as defined in claim 3 further characterized by;

a bladder being movably mounted over said cavity to overly a cassette mounted in said cavity that is positioned in a rear heel portion of said bottom sole;

said bladder being filled with a colored viscous fluid;

a passage for said fluid extending upwardly along a rear heel portion of said upper section of said shoe;

a vertically disposed chamber mounted in said rear heel portion of said upper section of said shoe, said chamber being in fluid connection with said passage to receive said colored viscous fluid and having a transparent wall section such that the fluid within said chamber is visible from the exterior of said shoe;

indicia marked in proximity to said transparent wall section to serve as an indicator to determine the level that said viscous fluid enters said chamber upon impact on said heel section of said outer sole that corresponds to a level of impact encountered by said cassette in said heel portion of said outer sole.

7. A cassette insert for an athletic shoe, said cassette characterized by:

a bottom section and a top section with at least one spring element interposed therebetween;

said bottom section and top section secured together to lock said at least one spring element in position therebetween;

one of said top and bottom sections of said cassette having an enclosing upright vertical wall that defines in part a spring seat;

the other of said top and bottom sections of said cassette having a tapered wall with a distal end that telescopically fits within the part of the spring seat of said one section with said tapered wall having its distal end spaced closer together than said vertical wall and said tapered wall diverging toward a base at said other of said top and bottom sections and said tapered wall abut a distal end of said upright vertical wall at a predetermined amount of motion of the top section toward the bottom section to form a compressive stop to resist further motion of the top section toward said bottom section.

8. A cassette for an athletic shoe as defined in claim 7 further characterized by;

said at least one spring element being at least one coil spring with an upper end mounted in a respective spring seat of the upper section and a lower end mounted in a respective spring seat of the bottom section of said cassette.

9. A cassette for an athletic shoe as defined in claim 7 further characterized by:

said top section and said bottom section connected together via a peripheral wall that surrounds said at least one spring element.

10. A cassette for an athletic shoe as defined in claim 9 further characterized by:

said peripheral wall having an outer facing surface that has outwardly extending protrusions that form part of a snap fit assembly constructed for snap fitting into a cavity within a shoe sole.

* * * * *